US009907992B2

(12) United States Patent
Tschann

(10) Patent No.: US 9,907,992 B2
(45) Date of Patent: Mar. 6, 2018

(54) OUTDOOR FITNESS RESISTANCE MECHANISM AND HOUSING

(71) Applicant: Landscape Structures Inc., Delano, MN (US)

(72) Inventor: Matthew A. Tschann, Burnsville, MN (US)

(73) Assignee: Landscape Structures Inc., Delano, MN (US)

( * ) Notice: Subject to any disclaimer, the term of this patent is extended or adjusted under 35 U.S.C. 154(b) by 0 days.

(21) Appl. No.: 15/715,850

(22) Filed: Sep. 26, 2017

(65) Prior Publication Data

US 2018/0015320 A1 Jan. 18, 2018

Related U.S. Application Data

(63) Continuation of application No. 14/799,167, filed on Jul. 14, 2015, now Pat. No. 9,802,074.
(Continued)

(51) Int. Cl.
*A63B 21/015* (2006.01)
*A63B 22/06* (2006.01)
(Continued)

(52) U.S. Cl.
CPC ..... *A63B 21/225* (2013.01); *A63B 21/00069* (2013.01); *A63B 21/015* (2013.01);
(Continued)

(58) Field of Classification Search
CPC ..... A63B 21/00058; A63B 21/00069; A63B 21/00072; A63B 21/00076; A63B 21/012;
(Continued)

(56) References Cited

U.S. PATENT DOCUMENTS 1,610,504 A 12/1926 Fitts
3,831,942 A 8/1974 Del Mar
(Continued)

FOREIGN PATENT DOCUMENTS

CN 201469981 U 5/2010
CN 201643537 U 11/2010
(Continued)

OTHER PUBLICATIONS

International Search Report and Written Opinion for International Application No. PCT/US2015/040558, dated Oct. 16, 2015, date of filing: Jul. 15, 2015, 14 pages.
(Continued)

*Primary Examiner* — Joshua Lee
(74) *Attorney, Agent, or Firm* — Kelly, Holt & Christenson, PLLC; Katherine M. Scholz

(57) ABSTRACT

A resistance mechanism for an exercising device is provided. The resistance mechanism comprises a housing configured to engage the exercise device. The housing is configured to translate a resistance from a resistance generator to the exercise device. The resistance mechanism also comprises a resistance adjustment mechanism configured to adjust a level of resistance provided by the resistance mechanism. Adjustment in a first direction increases a provided resistance, and adjustment in a second direction decreases the provided resistance. The resistance generator comprises a flywheel coupled to an indexing wedge. The resistance mechanism is configured to, when the adjustment mechanism adjusts in the first direction, push against the indexing wedge in a linear direction towards and against a brake arm, causing the brake arm to engage the flywheel, thereby increasing the level of resistance provided by the resistance mechanism to the outdoor exercise device.

20 Claims, 8 Drawing Sheets

Related U.S. Application Data

(60) Provisional application No. 62/026,467, filed on Jul. 18, 2014.

(51) Int. Cl.

| | |
|---|---|
| ***A63B 21/012*** | (2006.01) |
| ***A63B 21/22*** | (2006.01) |
| ***A63B 71/02*** | (2006.01) |
| *A63B 23/12* | (2006.01) |
| *A63B 22/00* | (2006.01) |
| *A63B 21/00* | (2006.01) |
| *A63B 22/04* | (2006.01) |

(52) U.S. Cl.
CPC ..... *A63B 22/0002* (2013.01); *A63B 71/02* (2013.01); *A63B 21/4029* (2015.10); *A63B 22/0056* (2013.01); *A63B 22/04* (2013.01); *A63B 22/0664* (2013.01); *A63B 23/1209* (2013.01); *A63B 2209/02* (2013.01)

(58) Field of Classification Search
CPC ... A63B 21/0125; A63B 21/015; A63B 21/22; A63B 21/222; A63B 21/225; A63B 21/227; A63B 22/06; A63B 2209/02; B62L 5/16; B62L 1/08; F16D 2125/66
See application file for complete search history.

(56) References Cited

U.S. PATENT DOCUMENTS

| | | | |
|---|---|---|---|
| 3,929,209 | A | 12/1975 | Peckham, Jr. |
| 4,007,927 | A | 2/1977 | Proctor |
| 4,047,715 | A | 9/1977 | Gjessing |
| 4,344,615 | A | 8/1982 | Carlson |
| 4,357,010 | A | 11/1982 | Telle |
| 4,391,352 | A | 7/1983 | Brown |
| 4,463,945 | A | 8/1984 | Spector |
| 4,620,703 | A | 11/1986 | Greenhut |
| 4,720,099 | A | 1/1988 | Carlson |
| 4,728,099 | A | 3/1988 | Pitre |
| 4,765,313 | A | 8/1988 | Voris |
| 4,772,013 | A | 9/1988 | Tarlow, Jr. |
| 4,789,153 | A | 12/1988 | Brown |
| 4,997,181 | A | 3/1991 | Lo |
| 5,051,638 | A | 9/1991 | Pyles |
| 5,062,633 | A | 11/1991 | Engel et al. |
| 5,064,034 | A | 11/1991 | Rupprecht et al. |
| 5,072,929 | A | 12/1991 | Peterson et al. |
| 5,224,727 | A | 7/1993 | Ramskugler |
| 5,256,124 | A | 10/1993 | Hughes |
| 5,342,261 | A | 8/1994 | Johnston |
| 5,514,053 | A | 5/1996 | Hawkins et al. |
| 5,547,422 | A | 8/1996 | Carballosa et al. |
| 5,626,209 | A | 5/1997 | Viola |
| 6,099,440 | A | 8/2000 | Schurter et al. |
| 6,468,186 | B2 | 10/2002 | Lay |
| 6,612,971 | B1 | 9/2003 | Morris |
| 6,648,802 | B2 | 11/2003 | Ware |
| 6,669,603 | B1 | 12/2003 | Forcillo |
| 7,011,607 | B2 | 3/2006 | Kolda et al. |
| 7,419,458 | B2 | 9/2008 | Forcillo |
| 7,497,812 | B2 | 3/2009 | Neff et al. |
| 7,530,932 | B2 | 5/2009 | Lofgren et al. |
| 7,662,071 | B2 | 2/2010 | Ditolla |
| 7,682,292 | B1 | 3/2010 | Lo |
| 7,699,758 | B1 | 4/2010 | Hoggan et al. |
| 7,901,334 | B2 | 3/2011 | Chen et al. |
| 8,052,581 | B1 | 11/2011 | Lohr et al. |
| 8,585,561 | B2 | 11/2013 | Watt et al. |
| 2001/0003110 | A1 | 6/2001 | Lay |
| 2001/0022029 | A1 | 9/2001 | Vary |
| 2005/0096192 | A1 | 5/2005 | Chen |
| 2008/0087505 | A1 | 4/2008 | Kobelt |
| 2009/0084639 | A1 | 4/2009 | Colegrove |
| 2010/0029159 | A1 | 2/2010 | Ishihara et al. |
| 2010/0062909 | A1 | 3/2010 | Hamilton |
| 2010/0298104 | A1 | 11/2010 | Turner |
| 2011/0017168 | A1 | 1/2011 | Gilpatrick |
| 2014/0262631 | A1 | 9/2014 | Cobb |

FOREIGN PATENT DOCUMENTS

| | | | |
|---|---|---|---|
| CN | 101623546 | B | 11/2011 |
| CN | 202029947 | U | 11/2011 |
| DE | 2153054 | A1 | 5/1973 |

OTHER PUBLICATIONS

International Preliminary Report on Patentability for PCT/US2015/040558 dated Feb. 2, 2017, 11 pages.

OUTDOOR FITNESS RESISTANCE MECHANISM AND HOUSING

CROSS-REFERENCE TO RELATED APPLICATION

The present application is a continuation of U.S. patent application Ser. No. 14/799,167, filed Jul. 14, 2015, which is based on and claims benefit of U.S. Provisional Patent Application Ser. No. 62/026,467, which was filed on Jul. 18, 2014, the contents of which is hereby incorporated by reference in its entirety.

BACKGROUND

Providing an outdoor fitness exercise machine presents many logistical challenges. The outdoor environment presents temperature at both the hot and cold extremes. Further, exercise equipment outdoors is also exposed to the elements—wind, rain and particulates. Additionally, providing consistent lubrication to the exercise equipment is a problem. For this reason, exercise equipment cannot merely be transferred from an indoor environment to an outdoor environment.

One particular challenge presenting outdoor fitness equipment is the ability to provide a resistance mechanism that is easy to operate by a user, presents a wide range of resistance options for exercise, and can hold up to the difficulties of the outdoor environment. A solution to these problems is desired.

SUMMARY

A resistance mechanism for an exercising device is provided. The resistance mechanism comprises a housing configured to engage the exercise device. The housing is configured to translate a resistance from a resistance generator to the exercise device. The resistance mechanism also comprises a resistance adjustment mechanism configured to adjust a level of resistance provided by the resistance mechanism. Adjustment in a first direction increases a provided resistance, and adjustment in a second direction decreases the provided resistance. The resistance generator comprises a flywheel coupled to an indexing wedge. The resistance mechanism is configured to, when the adjustment mechanism adjusts in the first direction, push against the indexing wedge in a linear direction towards and against a brake arm, causing the brake arm to engage the flywheel, thereby increasing the level of resistance provided by the resistance mechanism to the outdoor exercise device.

DETAILED DESCRIPTION OF THE DRAWINGS

In one embodiment of the present invention, a universal resistance mechanism with a housing is provided. In one embodiment, the housing is a universal housing that is configured to operate in a plurality of exercise equipment options, for example, the exercise devices present in FIGS. 1A-F. While FIGS. 1A-F illustrate an elliptical, a chest press, a shoulder press, and a stair stepper it is to be understood that the resistance mechanism could be implemented in a plurality of other exercise devices, for example.

Figures 1A, 1B:
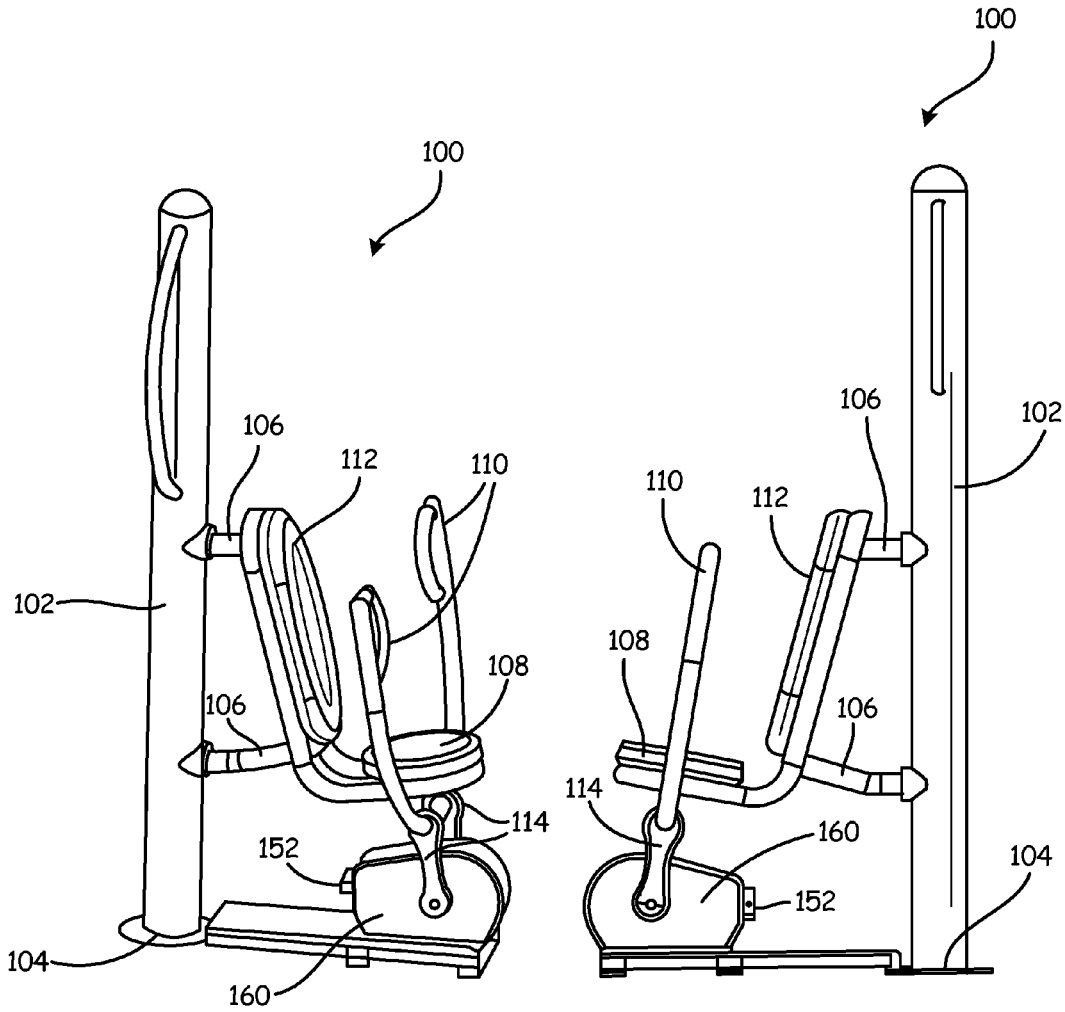
FIGS. 1A-1F depict a plurality of exercise devices that may be useful in embodiments of the present invention.

FIGS. 1A-F depict a plurality of exercise devices that may be useful in embodiments of the present invention. FIGS. 1A and 1B illustrate a chest press 100 that incorporates a resistance mechanism (not shown) located within housing 160. In one embodiment, chest press machine 100 illustratively comprises a post 102 that is connected to the ground at a fixed point 104. The advantage of having a post 102 connected to a fixed point 104 on the ground is that it may prevent, for example, theft of exercise equipment from an outdoor location such as a park. It also allows, for example, multiple exercise equipment options to be arranged about the post 102, allowing for a social exercise experience. In another embodiment, chest press machine 100 may be free moving. In a further embodiment, chest press machine 100 may only be fixed to the ground at fixed point 104.

In one embodiment, the chest press machine 100 comprises connections 106 that connect the post 102 to a seat 108 and/or a seatback 112 of the chest press machine. In one embodiment, the chest press machine 100 also includes one or more chest press arms 110. In one embodiment, the chest press arms provide adjustable levels of resistance, provided by the resistance mechanism located within the housing 160. In one embodiment, the resistance level provided by the resistance mechanism is translated to the chest press arms 110 through translation mechanism 114.

An adjustable resistance level offered to a user of the chest press machine 100 may, in one embodiment, be provided through a resistance mechanism 150. The resistance mechanism 150 may be located within a housing 160 that may or may not correspond directly to a size of the resistance mechanism 150. In one embodiment, the resistance mechanism 150 also includes a resistance adjustment mechanism 152. The resistance adjustment mechanism 152 allows a user of the chest press machine 100 to adjust a difficulty of the chest press machine. For example, a stronger person may desire greater resistance on the chest press arms 110 than a beginner. In one embodiment, the resistance adjustment mechanism 152 incorporates one or more button elements that allow a user to increase or decrease a resistance level. In another embodiment, the resistance adjustment mechanism 152 incorporates a knob that turns, allowing a user to increase or decrease resistance by rotating the knob. In another embodiment, the resistance adjustment mechanism 152 incorporates an alternative adjustment option.

Figure 1D:
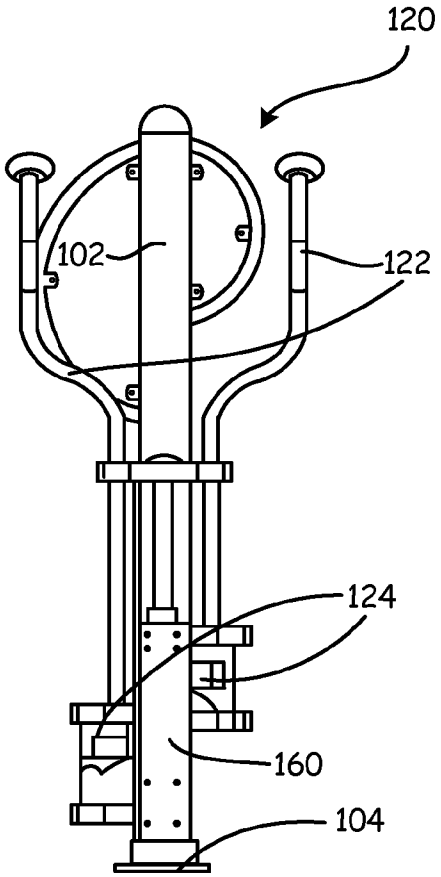
Figure 1C:
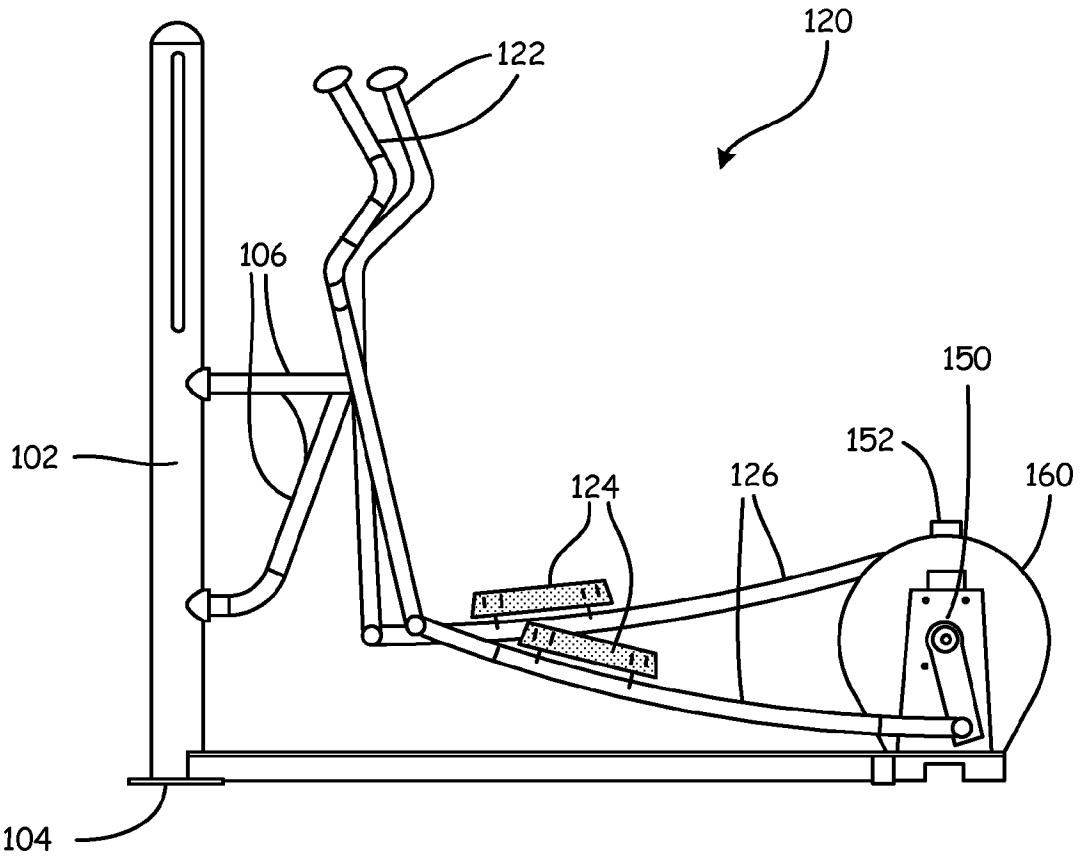

FIGS. 1C and 1D illustrate an elliptical machine 120 that also incorporates a resistance mechanism 150, located within housing 160. FIG. 1C illustrates a housing 160 with a window allowing a view of the resistance mechanism 150. However, in another embodiment, housing 160 may not allow for a view of the resistance mechanism 150. FIG. 1C illustrates a housing 160 significantly larger than the resistance mechanism 150. However, in another embodiment, housing 160 may be substantially the same size as the resistance mechanism 150. In another embodiment, the resistance mechanism 150 may be incorporated into the elliptical machine 120, or other exercise machine, without a separate housing 160. The resistance mechanism 150 translates resistance to the elliptical machine 120, in one embodiment, through one or more elliptical pedal levers 126 connected to the resistance mechanism 150. In this way, when a user of the elliptical machine 120 adjusts a resistance adjustment mechanism 152, their experience on the elliptical machine 120 changes. The elliptical machine 120 may comprise, in one embodiment, one or more elliptical arms 122 with or without handles. The elliptical machine 120 may also comprise one or more elliptical pedals 124 that are located on or near the elliptical pedal levers 126, and provide an engagement portion for the feet of a user.

Figure 1E:
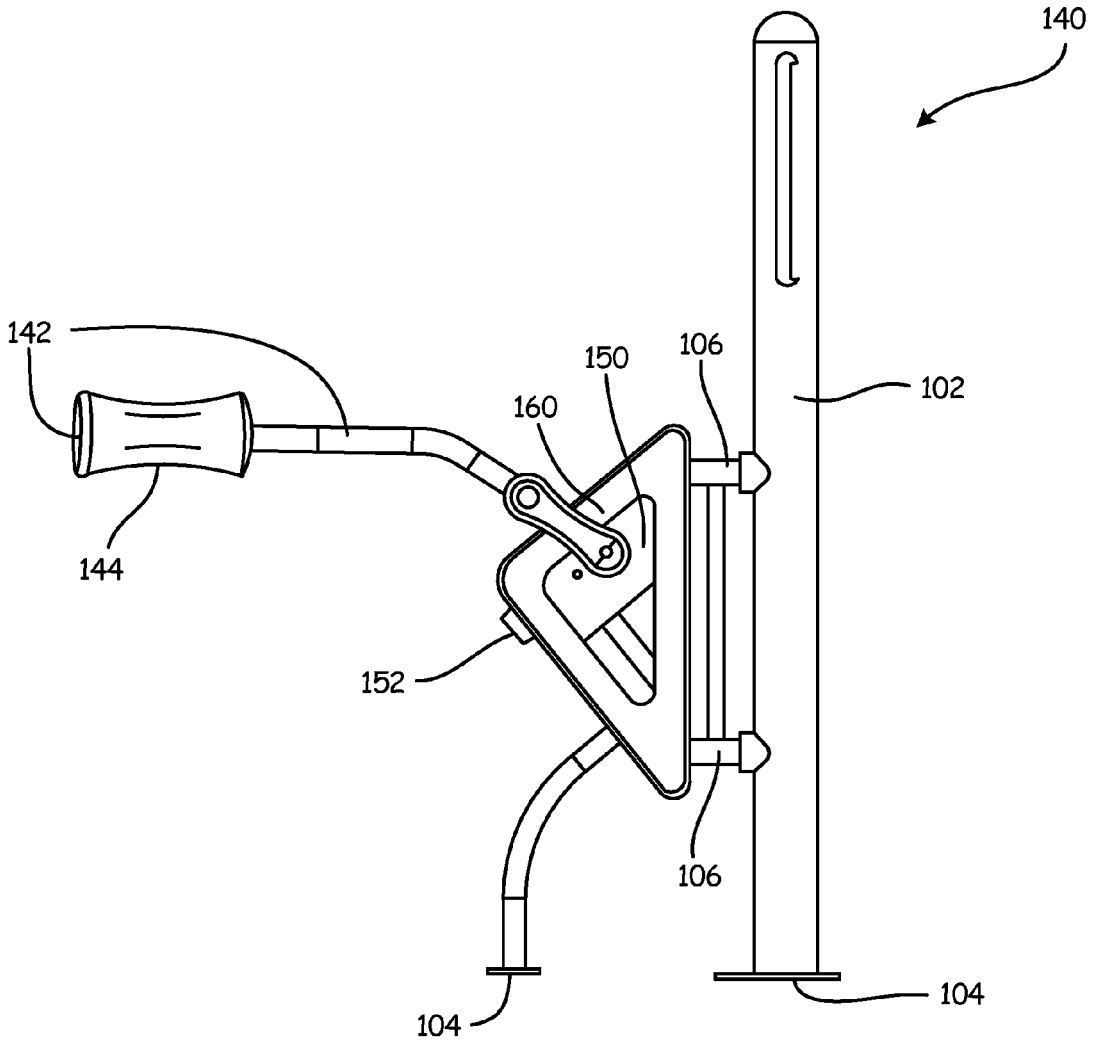

FIG. 1E illustrates a shoulder press machine 140 that includes the resistance mechanism 150 located within a housing 160. In one embodiment, such as that shown in FIG. 1E, the housing 160 is configured such that a user of the shoulder press machine 150 can see the resistance mechanism 150, for example through a plastic or glass window. However, in another embodiment, the housing 160 may be configured such that it obscures the resistance mechanism 150 from view. In one embodiment, the shoulder press machine comprises one or more shoulder press arms with pads 144.

Figure 1F:
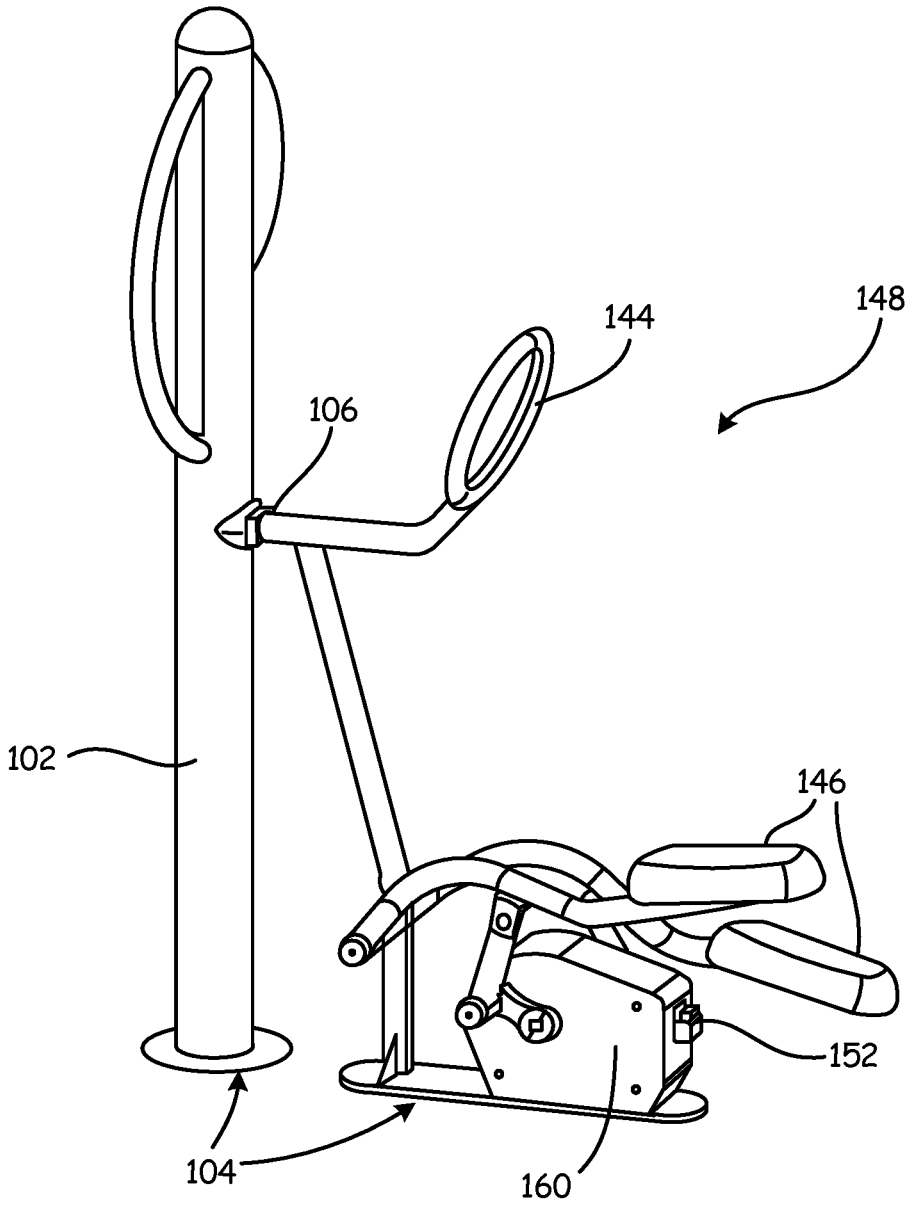

FIG. 1F illustrates a stepper machine 148 that includes the resistance mechanism 150 located within a housing 160, with a resistance mechanism 152. In one embodiment, the resistance mechanism 152 adjusts a resistance provided to a user of the stepper pedals 146. The stepper machine 148 may also include one or more stepper handles 144.

Figure 2A:
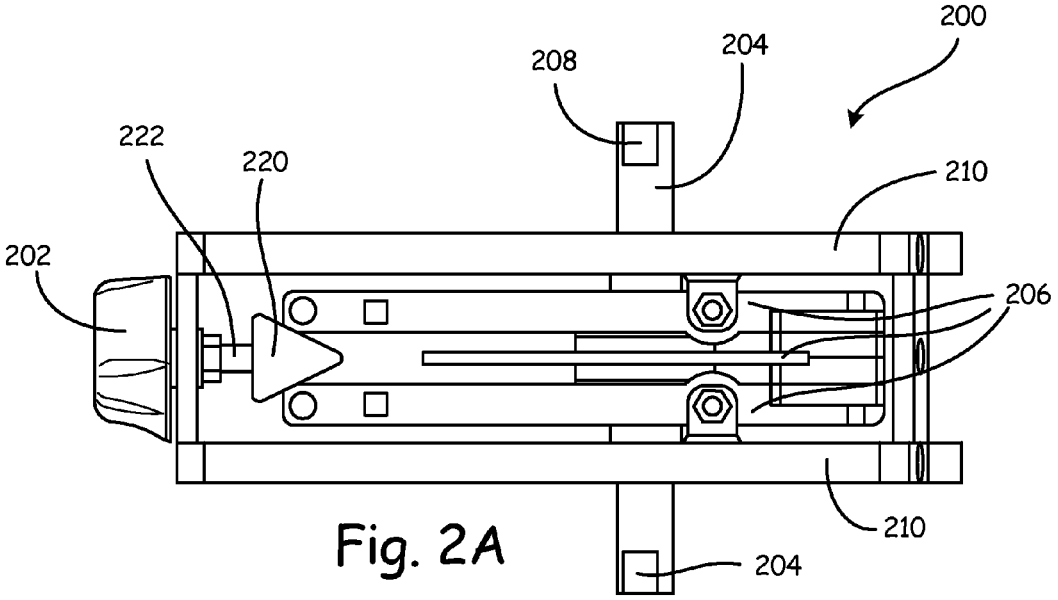
FIGS. 2A-D depict a plurality of views of a resistance mechanism that may be useful in one embodiment of the present invention.

FIGS. 2A-D depict a plurality of views of a resistance mechanism that may be useful in one embodiment of the present invention. FIG. 2A illustrates a top down view of a resistance mechanism 200. In one embodiment, the resistance mechanism 200 may be similar to the resistance mechanism 150 shown in FIGS. 1A-E. In one embodiment, the resistance mechanism 200 includes a resistance adjustment mechanism 202. In one embodiment, resistance adjustment mechanism 202 provides a continuous range of resistance levels as a user actuates the resistance adjustment mechanism 202. In another embodiment, the resistance adjustment mechanism moves through a series of preset adjustment levels. While FIG. 2A illustrates a resistance adjustment mechanism 202 that is actuated by turning, in another embodiment the resistance actuator could be a push button or buttons, that a user actuates in order increase or decrease the resistance level.

Resistance mechanism 200 may comprise one or more engagement points 204. Engagement points 204 allow the resistance mechanism to be utilized with a plurality of exercise machines, such as chest press machine 100, elliptical machine 120, or shoulder press machine 140, in one embodiment. Engagement points 204 may comprise one or more engagement mechanisms 208. The engagement mechanisms, in one embodiment, engage with one or more of the moving parts of an exercise machine (e.g. chest press arms 110, elliptical pedal levers 126 or shoulder press arms 142), such as the elliptical pedal levers 126, or a translation feature of the exercise machine, such as translation feature 114 of the chest press machine 100. Through such engagement, the variable resistance provided by the resistance mechanism 200 is provided to a user of the exercise equipment.

In one embodiment, the one or more engagement mechanisms 208 may operate in a key and lock configuration such that the engagement mechanism 208 connects with a corresponding engagement mechanism on a moving part or other translation feature in an exercise device. In one embodiment, the resistance mechanism 200 further includes a resistance translation feature 206, which translates the indicated resistance level input by a user through the resistance adjustment mechanism 202 to the engagement point 204, such that when a user actuates the resistance adjustment mechanism 202 the input resistance level is translated to the exercise device of choice. For example, if in an embodiment where the resistance mechanism 200 is input into chest press machine 100, actuation of the resistance adjustment mechanism will cause the translation feature 206 to either increase or decrease the resistance of the chest press arms 100 to a user.

In one embodiment, such as that shown in FIG. 2A, the translation feature 206 comprises at least a resistance wedge 220 connected to a resistance shaft 222. In one embodiment, when the resistance adjustment mechanism 202 is actuated, the length of the resistance shaft exposed is either increased or decreased such that the resistance wedge 220 is moved forward or backward, providing an increased or decreased amount of force on the translation feature 206. In one embodiment, the translation feature 206 may comprise at least one or more brake pads that engage with the resistance wedge 220.

Figure 2B:
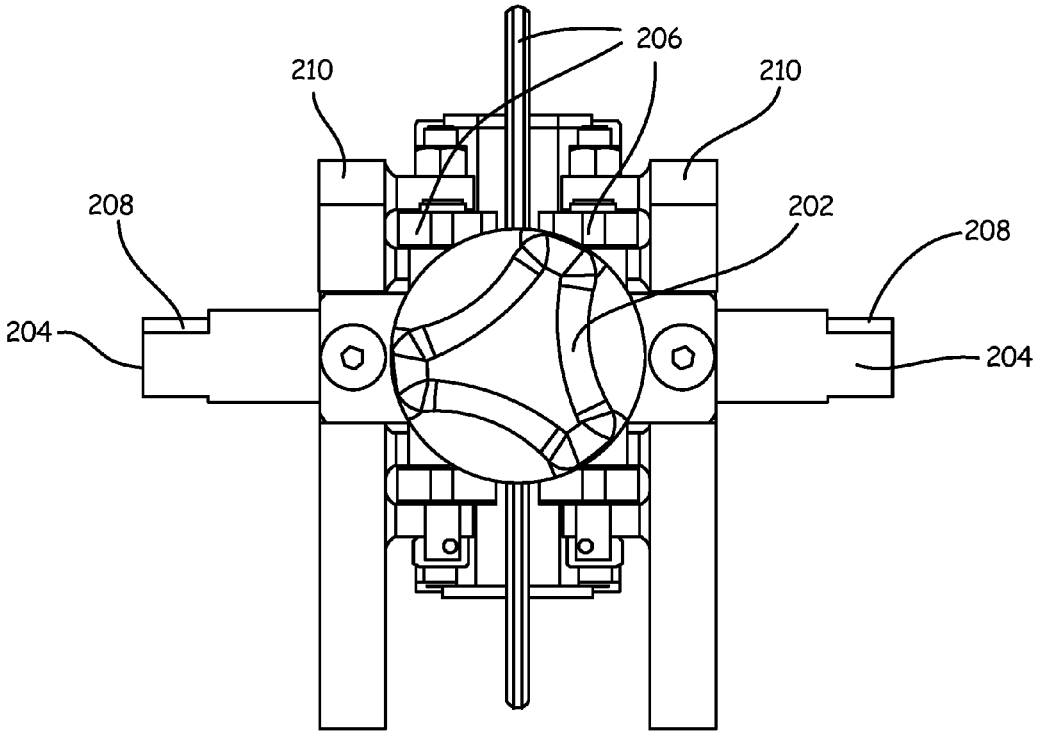

FIG. 2B illustrates a front view of a resistance mechanism 200 in one embodiment. In the embodiment shown in FIG. 2B, substantially all of the translation features 206 are comprised within a pair of resistance mechanism housing walls 210 on either side of the translation feature. However, in one embodiment, the translation feature 206 may also extend above or below the sides of resistance mechanism housing wall 210. For example, as shown in FIG. 2B a flywheel is shown to extend above a height of an upper edge of housing walls 210. However, in another embodiment the flywheel portion of translation feature 206 may extend below the lower edge of resistance mechanism housing wall 210. In a further embodiment, the housing walls 210 may be configured to be of a length that is the same as that of a flywheel feature that is part of the translation feature 206.

Figure 2C:
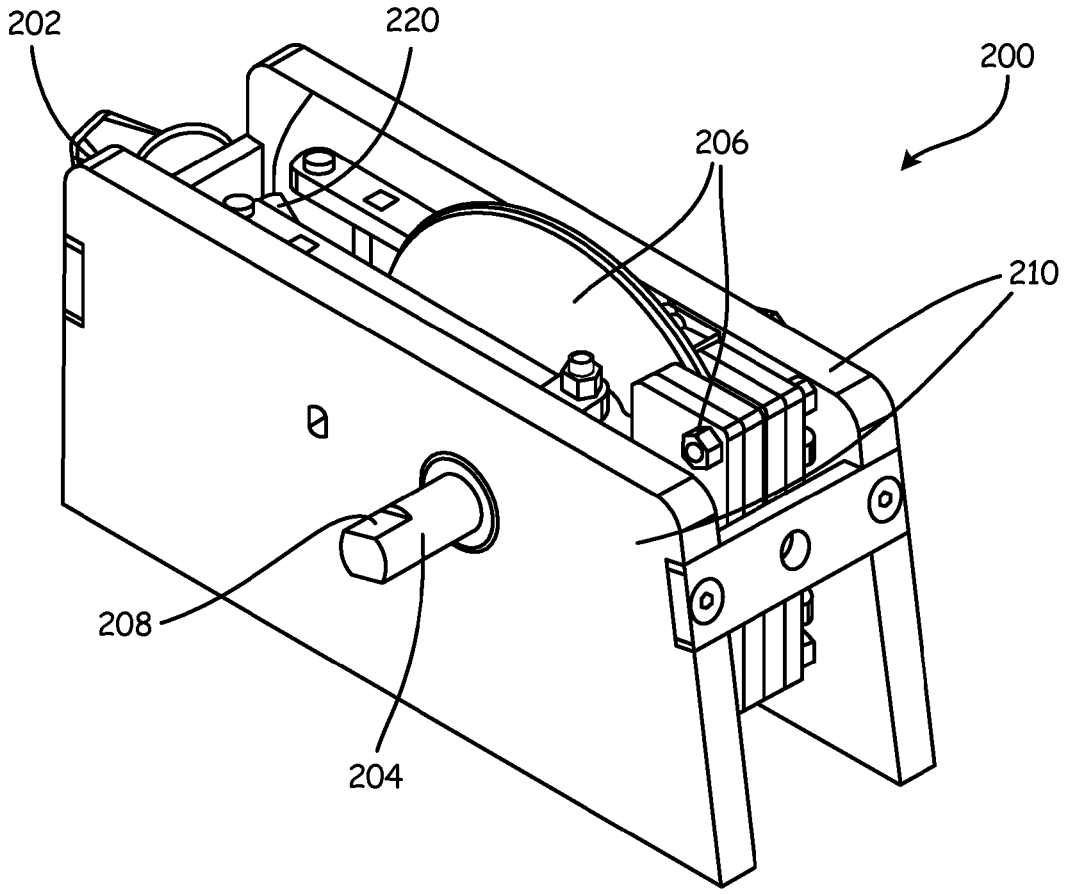
Figure 2D:
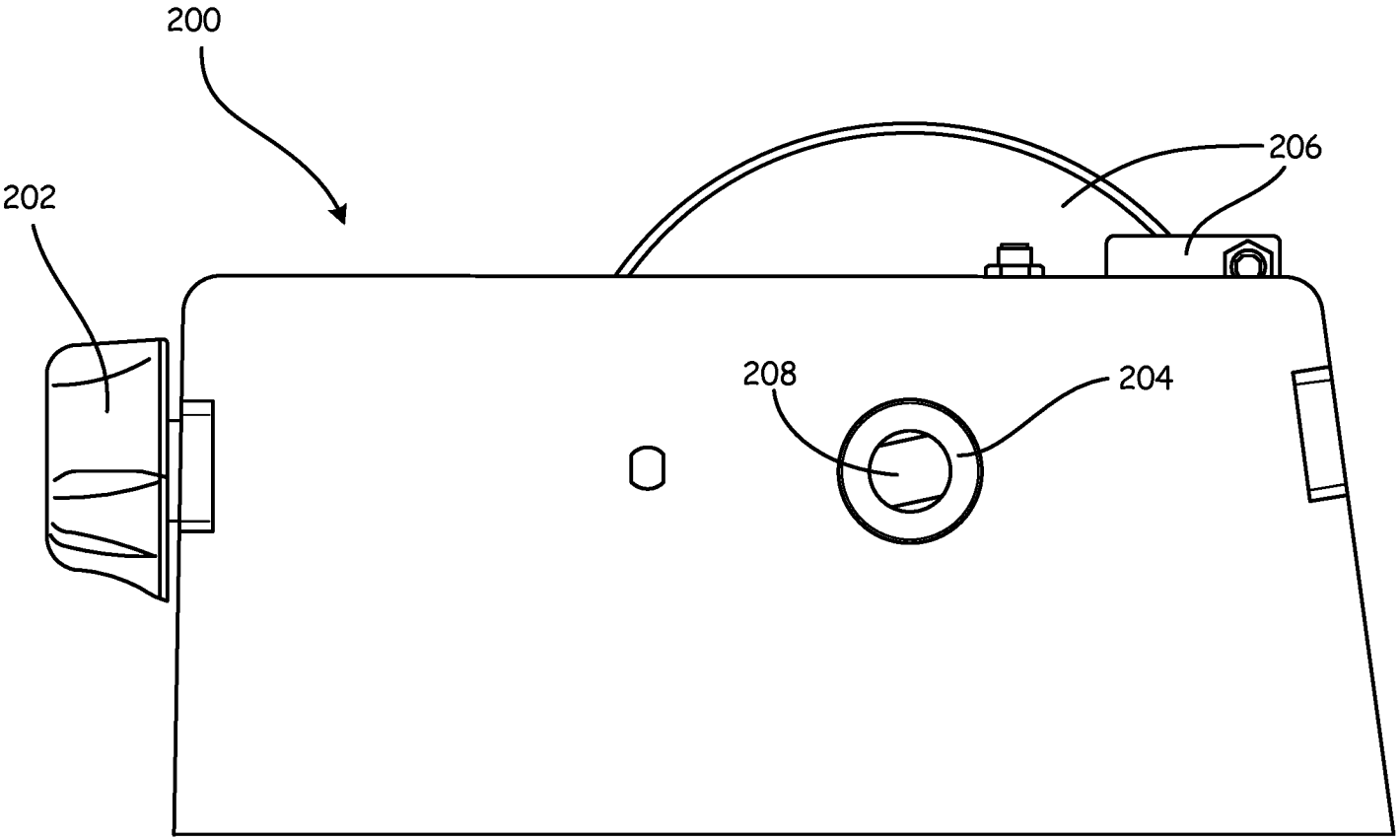

FIG. 2C illustrates a perspective view of resistance mechanism 200. FIG. 2D illustrates a substantially side view of resistance mechanism 200 in one embodiment.

In one embodiment, the resistance mechanism 200 may be held together by bolts that extend through at least a portion of the resistance mechanism housing walls 210. In another embodiment, the securing mechanism may comprise screws. In a further embodiment, the securing mechanism may comprise welding or other appropriate mechanism for securing the resistance mechanism 200. The resistance mechanism 200 may be configured such that it fits within a housing 160, for example, to provide further protection from the elements once located within an exercise device. In another embodiment, the resistance mechanism 200 may be a part of housing 160, such that it cannot be separately removed from the housing 160.

Figure 3:
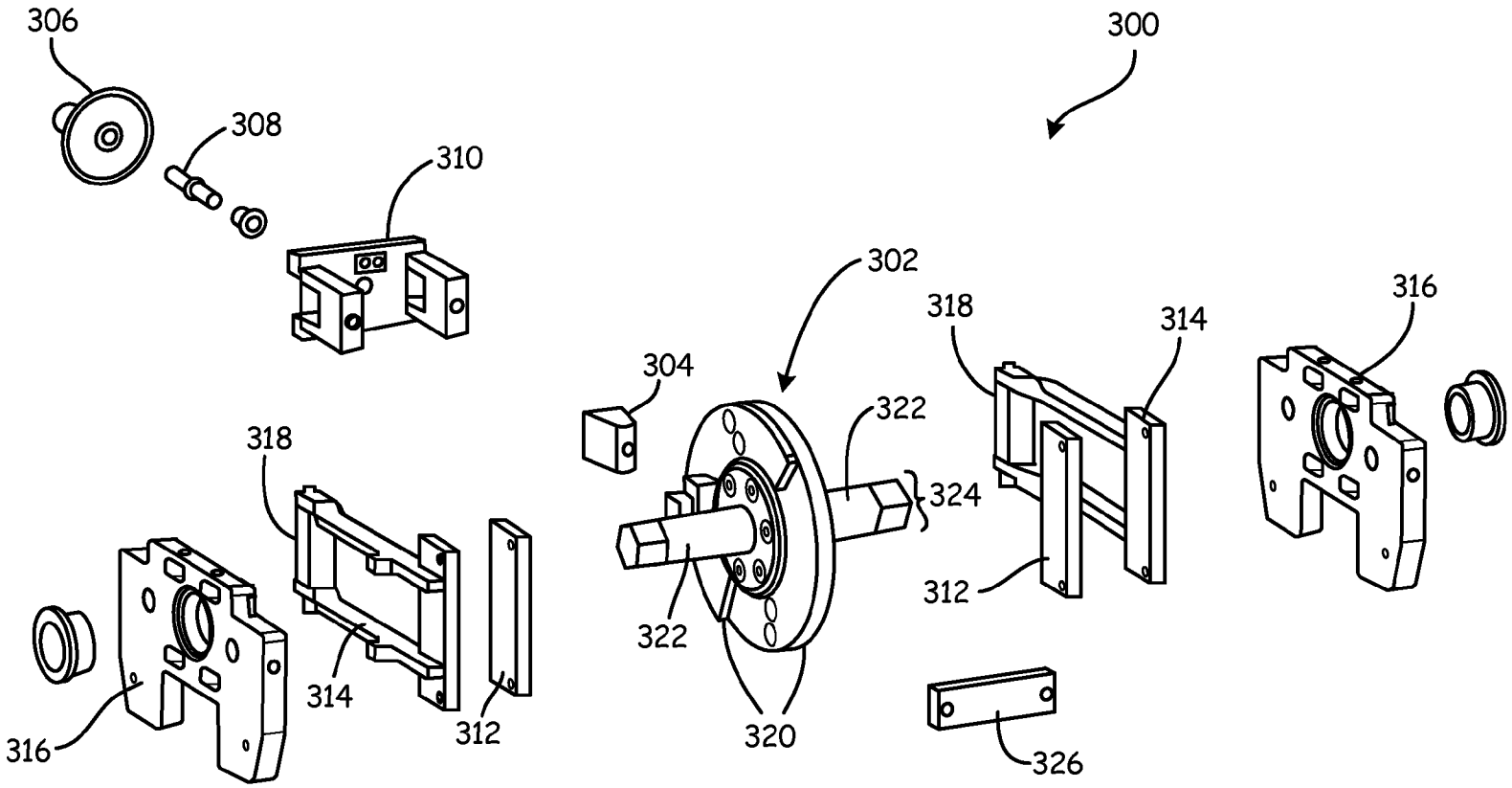
FIG. 3 presents an exploded view of a resistance mechanism that may be useful in one embodiment of the present invention.

FIG. 3 illustrates an exploded view of a resistance mechanism 300. In one embodiment, resistance mechanism 300 is substantially similar to resistance mechanism 200. In one embodiment, the resistance mechanism 300 includes at least a flywheel assembly 302. The flywheel assembly 302 comprises at least one resistance disc 320. In one embodiment, the flywheel assembly includes one resistance disc 320. In one embodiment, the flywheel assembly includes two, or more than two resistance discs 320. The resistance discs 320 may, in one embodiment, directly contact the resistance wedge 220. The resistance discs, on one embodiment, experience negligible wear when contacting the resistance wedge 220. In an embodiment where a flywheel directly contacts the resistance wedge 220, the flywheel may wear, causing the resistance mechanism 300 to wear out and produce an undesired noise while in use. Addition of the resistance discs 320, therefore, may increase the functional life of the resistance mechanism 300.

The flywheel assembly may also comprise at least one connection 322. The connection 322 may include one or more connection features 324. In one embodiment, the connection features 324 allow the resistance mechanism 300 to engage with, and provide variable resistance for, an exercise device, for example, chest press machine 100, elliptical machine 120, or shoulder press machine 140. In one embodiment, the connection features 324 comprise grooves, ridges, or other geometry configured to connect to a corresponding connection mechanism on an exercise device. In one embodiment, the flywheel assembly is connected to a housing wall, for example, resistance mechanism housing walls 210 directly. In another embodiment, the flywheel assembly is connected through a mounting plate 326. In one embodiment, the resistance mechanism 300, as shown in FIG. 3 with exemplary resistance mechanism housing walls removed for illustration.

In one embodiment, resistance mechanism 300 includes a resistance adjustment mechanism 306. In the embodiment shown in FIG. 3, the resistance adjustment mechanism 306 comprises a knob. However, in another embodiment, the resistance adjustment mechanism could comprise one or more buttons, for example one button to increase and one to decrease resistance, or any other appropriate resistance adjustment mechanism. In one embodiment, the resistance adjustment mechanism 306 is connected to a resistance adjustment mechanism shaft 308 which in turn is connected to a brake wedge 304. In one embodiment, as a user actuates the resistance adjustment mechanism 306 the resistance adjustment mechanism shaft 308 engages the brake wedge 304 such that the brake wedge 304 is pushed closer to the flywheel assembly 302, or further away from the flywheel assembly 302, thus either increasing or decreasing a resistance provided respectively. In one embodiment, the resistance adjustment mechanism and resistance adjustment mechanism shaft are located within the resistance mechanism 300 such that they are mounted on a resistance adjustment mechanism mount 310. However, in another embodiment, another mechanism for securing the resistance adjustment mechanism 300 may be used.

In one embodiment, the resistance mechanism may include one or more brake arms 314. As shown in FIG. 3, a brake arm 314 is located on either side of the flywheel assembly and comprises a wear pad 312. However, in another embodiment, only one brake arm 314 may be provided on either side of the flywheel assembly 302. In one embodiment, the resistance mechanism further includes one or more side supports 316 located on the outside of brake arms 314. In other embodiment, side supports 316 may be part of hosing walls, not shown in FIG. 3. Brake arm 314 may further include a brake roller 318, in one embodiment. The resistance mechanism 300 is configured such that when the resistance adjustment mechanism 306 is actuated the brake wedge 304 is pushed against the one or more wear pads 312. In one embodiment, the resistance adjustment mechanism 306 may include a spring pin. In one embodiment, the resistance adjustment mechanism shaft 308 may be located within an Oilite™ bushing that engages with the resistance adjustment mechanism mount 310. In one embodiment, on another side of the resistance adjustment mechanism mount 310, a thrust washer may engage the brake wedge 304. In one embodiment, the flywheel shaft assembly may further include one or more stops, or limiters. In one embodiment, the side supports 316 may further include an Oilite™ bearing, through which the connection mechanism may extend. In one embodiment, the brake arm may further include one or more cotter pins and/or one more clevis pins.

The brake wedge 304 may, in one embodiment, be an indexing wedge that allows a user of the resistance mechanism 300 to increase or decrease resistance by applying force, in one embodiment, through the resistance adjustment mechanism, on the wedge 304 such that force is applied to wear pads 312 which in turn transfer pressure against the one or more resistance discs within the flywheel assembly.

In one embodiment, the wear pads 312 are comprised of Kevlar®, available from DuPont, for example, or other para-aramid synthetic fiber. In another embodiment, the wear pads 312 may also be comprised of plastic, ceramic, or any other suitable material which would provide similar adjustable resistance. In one embodiment, the use of Kevlar® wear pads allows the resistance mechanism 300 to have a long service life when placed within an outdoor exercise equipment device. Additionally, the wear pads are designed to provide an easy and cost effective replacement once they have reached the end of their service life, without replacement required for any other portion of the resistance mechanism 300. As shown in FIG. 2A, in one embodiment, the wedge 304 does not engage directly with discs 320. However, in another embodiment, the wedge 304 may engage directly with one or more internal structures on either side of the disc or discs 320, for example, the one or more brake arms 314 with brake pads 312. However, in another embodiment, the brake wedge 304 may engage directly with the flywheel assembly, specifically resistance discs 320.

In one embodiment, support structures, for example, mounting plates 326, resistance adjustment mechanism mounts 310, and side supports 316 are provided to stabilize the resistance mechanism 300 within a housing, for example, housing 160. These support structures may be held in place through, for example, bolts, screws, or a welding process. The location of support structures, at least on the front and back of the resistance mechanism housing, further provides stabilization for the resistance mechanism 300, ensuring that the resistance mechanism 300 has a long working life within an outdoor exercise device.

In one embodiment, the resistance mechanism 300 is fully contained, such that ongoing maintenance is not required. In one embodiment, the resistance mechanism 300 is self-lubricating. In another embodiment, the resistance mechanism requires no additional lubrication once placed within a housing 160. In one embodiment, the resistance mechanism 300 is designed to be enclosed within a housing, for example, housing 160, such that it is not exposed to the elements.

An advantage of a universal resistance mechanism (such as that shown in FIGS. 1-3) is that it allows for resistance to be used in exercise devices located in an outdoor environment, for example, one where no electrical or other power source is readily available. This allows for the device to be utilized within an exercise machine located outside, for example, on a playground or in a park. In one embodiment, a plurality of exercise devices may be located in an area, for example, connected at multiple connection points to a pole 102, or other permanent structure, such as a wall or a bench. In one embodiment, for example, a plurality of elliptical machines 120 are connected to the same pole, allowing multiple users to exercise in a group utilizing exercise devices incorporating a resistance mechanism, such as resistance mechanism 300.

Although the present invention has been described with reference to preferred embodiments, workers skilled in the art will recognize that changes may be made in form and detail without departing from the spirit and scope of the invention.

What is claimed is:

1. A resistance mechanism for an exercise device, the mechanism comprising:

a housing configured to engage the exercise device, wherein the housing is configured to translate a resistance from a resistance generator to the exercise device;

a resistance adjustment mechanism configured to adjust a level of resistance provided by the resistance generator, where adjustment in a first direction increases a provided resistance, and adjustment in a second direction decreases the provided resistance; and wherein the resistance generator comprises a flywheel coupled to an indexing wedge, wherein the resistance mechanism is configured to, when the adjustment mechanism adjusts in the first direction, push against the indexing wedge in a linear direction towards and against a brake arm, causing the brake arm to engage the flywheel, thereby increasing the level of resistance provided by the resistance mechanism to the exercise device.

2. The resistance mechanism of claim 1, wherein the exercise device is mounted in an outdoor location, and wherein the resistance mechanism and the exercise device comprise substantially weather-proof materials.

3. The resistance mechanism of claim 1, wherein the resistance generator is contained within the housing while the resistance adjustment mechanism is accessible outside the housing.

4. The resistance mechanism of claim 1, wherein the exercise device comprises a chest press, wherein the resistance mechanism adjusts a resistance of a chest press arm.

5. The resistance mechanism of claim 1, wherein the exercise device comprises an elliptical machine, wherein the resistance mechanism adjusts a resistance provided by the elliptical machine.

6. The resistance mechanism of claim 1, wherein the exercise device comprises a shoulder press, wherein the resistance mechanism adjusts a resistance level provided by a shoulder press.

7. The resistance mechanism of claim 1, wherein the exercise device comprises a stepper machine, and the resistance mechanism adjusts a resistance of a stepper pedal.

8. An outdoor exercise machine comprising:

a user engagement feature;

a resistance adjustment mechanism configured to allow for adjustment of a resistance level of the outdoor exercise machine;

a resistance mechanism configured to provide an adjustable resistance to the outdoor exercise machine, when resistance adjustment mechanism is adjusted;

wherein the resistance adjuster mechanism, when adjusted in a first direction, causes an indexing wedge to push against a brake arm, causing the brake arm to engage a flywheel, thereby increasing the level of resistance of the user engagement feature; and wherein the outdoor exercise machine comprises substantially weather resistant materials.

9. The outdoor exercise machine of claim 8, wherein the user engagement feature is selected from the group consisting of: a chest press, an elliptical machine, a shoulder press, and a stepper machine.

10. The outdoor exercise machine of claim 8, wherein the outdoor exercise machine also comprises a housing configured to house the resistance mechanism such that it is inaccessible to a user.

11. The outdoor exercise machine of claim 8, wherein the resistance adjustment mechanism is configured to, when actuated, move through a continuum of resistance levels.

12. The outdoor exercise machine of claim 8, wherein the resistance mechanism, when actuated, is configured to move through a discrete number of resistance level options.

13. The outdoor exercise machine of claim 8, wherein the brake arm comprises a wear pad, and wherein the index wedge engages the wear pad.

14. The outdoor exercise machine of claim 13, wherein the wear pad comprises a para-aramid synthetic fiber.

15. The outdoor exercise machine of claim 8, wherein the outdoor exercise machine is configured to be permanently mounted in an outdoor location.

16. A resistance mechanism configured to be used in an outdoor environment, the resistance mechanism comprising:

an adjustment mechanism configured to, when actuated in a first direction, increase resistance provided by the resistance mechanism, and, in a second direction, decrease resistance provided by the resistance mechanism;

a brake arm;

a flywheel coupled to an indexing wedge;

wherein the resistance mechanism is configured to, when the adjustment mechanism adjusts in the first direction, push against the indexing wedge in a linear direction towards and against the brake arm, causing the brake arm to engage the flywheel, thereby increasing the level of resistance provided by the resistance mechanism; and wherein the brake arm, flywheel and indexing wedge are housed within a substantially weather-proof housing such that the resistance mechanism is substantially weatherproof.

17. The resistance mechanism of claim 16, wherein the brake arm comprises a wear pad.

18. The resistance mechanism of claim 17, wherein the flywheel comprises a resistance disc configured to contact the brake pad.

19. The resistance mechanism of claim 16, wherein the resistance mechanism is self-lubricating.

20. The resistance mechanism of claim 16, and further comprising a connecting feature configured to, when coupled to a receiving device, translate the resistance provided by the resistance mechanism to the receiving device.

* * * * *